United States Patent [19]

Kojima et al.

[11] Patent Number: 4,572,244

[45] Date of Patent: Feb. 25, 1986

[54] WARP LET-OFF MOTION FOR LOOM HAVING TWO WARP BEAMS

[75] Inventors: Shuichi Kojima; Masashi Nakao; Miyuki Gotoh; Takao Ishido; Shuichiro Imamura, all of Tokyo, Japan

[73] Assignee: Nissan Motor Co., Ltd., Yokohama, Japan

[21] Appl. No.: 645,152

[22] Filed: Aug. 28, 1984

[30] Foreign Application Priority Data

Aug. 31, 1983 [JP] Japan ..... 58-157958

[51] Int. Cl.[4] ..... D03D 49/06

[52] U.S. Cl. ..... 139/103; 139/110

[58] Field of Search ..... 139/103, 110, 114, 109

[56] References Cited

U.S. PATENT DOCUMENTS

| | | | |
|---|---|---|---|
| 1,154,251 | 9/1915 | Keeton | 139/103 |
| 3,426,806 | 2/1969 | Pfarrwaller | 139/103 |
| 4,262,706 | 4/1981 | Popp et al. | 139/103 |

FOREIGN PATENT DOCUMENTS

| | | | |
|---|---|---|---|
| 864928 | 4/1958 | United Kingdom | 139/103 |

*Primary Examiner*—Henry S. Jaudon
*Assistant Examiner*—S. Shongut
*Attorney, Agent, or Firm*—Schwartz, Jeffery, Schwaab, Mack, Blumenthal & Evans

[57] ABSTRACT

A loom having left and right warp beams and a common tension roller is provided with an electric or mechanical control system, which detects forces exerted on left and right supports of the tension roller by the warp threads of both warp beams, and produces a left control signal corresponding to a tension of the warp threads of the left warp beam and a right control signal corresponding to a tension of the warp threads of the right warp beam in accordance with the detected forces. The rotational speeds of the left and right warp beams are controlled individually in accordance with the left and right control signals, respectively.

12 Claims, 12 Drawing Figures

WARP LET-OFF MOTION FOR LOOM HAVING TWO WARP BEAMS

BACKGROUND OF THE INVENTION

The present invention relates to a warp let-off motion for a loom of a type in which warp threads are delivered from two warp beams.

U.S. Pat. No. 4,262,706 shows a loom having two warp beams, in which a tension roller common to both warp beams is supported at both ends by left and right bearing means in such a manner that each end of the tension roller is movable in accordance with a variation of a load exerted on the support at the end of the tension roller by the warp tension. The rotational speed of each warp beam is controlled individually as a function of each end position of the tension roller.

If, for example, the warp tension of the left warp beam increases in this loom, the load acting on the left end support of the tension roller increases, so that the left end of the tension roller is moved and the rotational speed of the left warp beam is changed in accordance with the displacement of the left end of the tension roller. In this case, however, the increase of the warp tension of the left warp beam also increases the load acting on the right support of the tension roller more or less. Therefore, the right end of the tension roller is also moved, and the rotational speed of the right warp beam is changed while the warp tension of the right warp remains unchanged. Thus, the warp tension is varied uselessly in the right warp beam.

SUMMARY OF THE INVENTION

It is an object of the present invention to provide a loom in which the warp let-off speeds of two warp beams are controlled adequately in accordance with the respective warp tensions of the two warp beams without being affected by the warp tension of each other.

According to the present invention, warp tension variations of left and right warp beams are determined at least approximately with electric or mechanical means by detecting loads exerted on left and right supports of a tension roller by the warp tensions of the left and right warp beams and by resolving each of the detected loads into a component part attributable to the warp tension of the left warp beam and a component part attributable to the warp tension of the right warp beam. The rotational speeds of the left and right warp beams are controlled individually in accordance with the determined warp tension variations of the left and right warp beams, respectively. A loom of the present invention comprises left and right warp beams, a common tension roller, electric or mechanical left and right load sensing means for sensing, respectively, loads acting at left and right support points of the tension roller, electric or mechanical controlling means for finding, at least approximately, variations of the warp tensions of the left and right warp beams by resolving each of the detected loads into component parts attributable to the warp tensions of the left and right warp beams, respectively, and left and right warp let-off speed regulating means for respectively controlling the rotational speeds of the left and right warp beams in accordance with the left and right warp tension variations determined by the controlling means.

DETAILED DESCRIPTION OF THE INVENTION

A first embodiment of the present invention is shown in FIGS. 1 to 6. A loom of this embodiment has left and right load cells for detecting respective loads acting on left and right supports of a tension roller, and electric controlling means which calculates, from the detected loads, respective warp tensions of left and right warp beams, which act on the tension roller and are divided between the left and right supports. The controlling means controls the rotational speed of each warp beam individually in accordance with the determined each respective warp tension.

Figure 1:
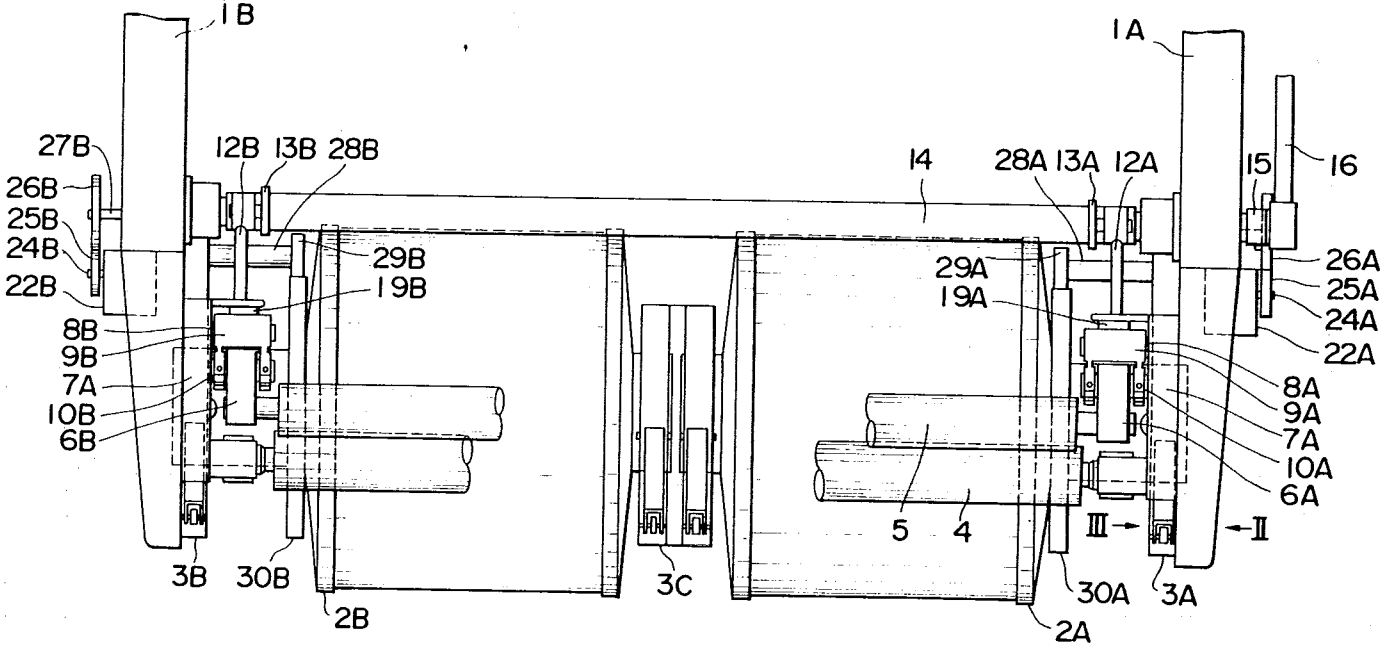
FIG. 1 is a plan view of the rear of a loom of a first embodiment according to the present invention.
Figure 2:
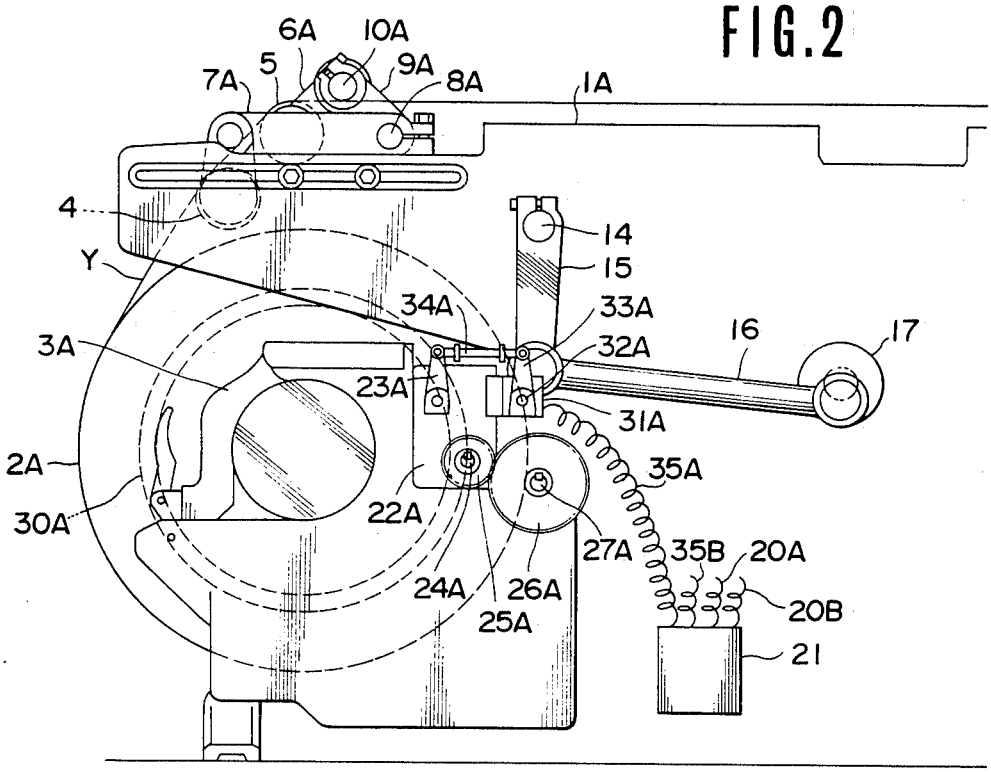
FIG. 2 is a side elevation taken in a direction of an arrow II of FIG. 1.
Figure 3:
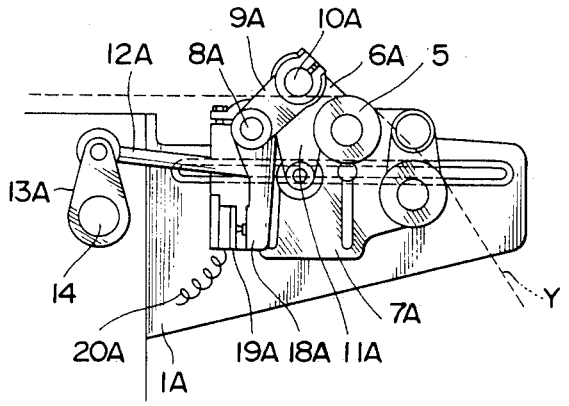
FIG. 3 is a side elevation taken in a direction of an arrow III of FIG. 1.

As shown in FIGS. 1 to 3, the loom has left and right loom frames 1A and 1B, and left and right warp beams 2A and 2B. (The left frame 1A and the left warp beam 2A are shown at the right in FIG. 1.) Shafts of the left and right warp beams 2A and 2B are supported by warp beam support members 3A, 3B and 3C. The loom further has a guide roller or roll 4 and a tension roller or roll 5. Warp threads Y are drawn out from the left and right warp beams 2A and 2B through the guide roller 4 and the tension roller 5.

The left and right warp beams 2A and 2B have, respectively, left and right warp let-off mechanisms mounted on the loom frames 1A and 1B, respectively. The left and right warp let-off mechanisms have the same construction. Only the left warp let-off mechanism is shown in FIGS. 2 and 3, and described hereinafter.

A left end of the tension roller 5 is supported by a left support lever 6A in such a manner that the tension roller 5 can rotate. The left support lever 6A is connected with a left tension lever 9A so that the left support lever 6A can rotate about a pin 10A mounted on the left tension lever 9A. The tension lever 9A is rotatable on a shaft 8A fixed to a bracket 7A, which is mounted on the left frame 1A in such a manner that the position of the bracket 7A is adjustable.

The support lever 6A has an arm 11A, which is connected with a lever 13A through a connecting rod 12A, as shown in FIG. 3. The lever 13A is fixed to a shaft 14 which is rotatably mounted on the frames 1A and 1B. A lever 15 is fixed to the shaft 14, as shown in FIG. 2. The lever 15 is connected through a connecting rod 16 with a crank 17 fixed to a main shaft (not shown) of the loom. The rotational movement of the crank 17 is transmitted through the connecting rod 16, the lever 15, the shaft 14, the lever 13A and the connecting rod 12A to the support lever 6A. Therefore, the left support lever 6A and a corresponding right support lever 6B of the right warp let-off mechanism swing and give an easing motion to the tension roller 5.

The tension lever 9A has an arm 18A, which is confronted with a left load cell 19A fixed to the bracket 7A for detecting a load. When the tension lever 9A is rotated in a clockwise direction in FIG. 3 by a warp tension acting on the tension roller 5, the arm 18A of the tension lever 9A exerts a pressing force on the load cell 19A, which produces an electric signal indicative of the applied pressing force.

The left load cell 19A is connected with a control panel 21 by a lead 20A. A right load cell 19B of the right warp let-off mechanism is also connected with the control panel 21 by a lead 20B.

A left speed change device 22A is fixed to the left frame 1A. An input shaft of the speed change device 22A is driven by the main shaft of the loom. The speed change device 22A reduces the speed according to a speed reduction ratio determined by a speed change lever 23A. The rotational movement of an output shaft 24A of the speed change device 22A is transmitted through a gear 25A fixedly mounted on the output shaft 24A, and a gear 26A meshing with the gear 25A, to a shaft 27A. The rotational movement of the shaft 27A is further transmitted through an unshown left speed reducer to the left warp beam 2A. A gear 29A fixedly mounted on an output shaft 28A of the speed reducer is in mesh with a gear 30A fixed to one side of the left warp beam 2A.

The speed change lever 23A of the left speed change device 22A is connected through a connecting rod 34A with a lever 33A which is fixed to an output shaft 32A of a left pulse motor or stepping motor 31A fixed to the left frame 1A. The pulse motor 31A is connected with the control panel 21 by a lead 35A. A right pulse motor 31B of the right warp let-off mechanism is also connected with the control panel 21 by a lead 35B.

Figure 4:
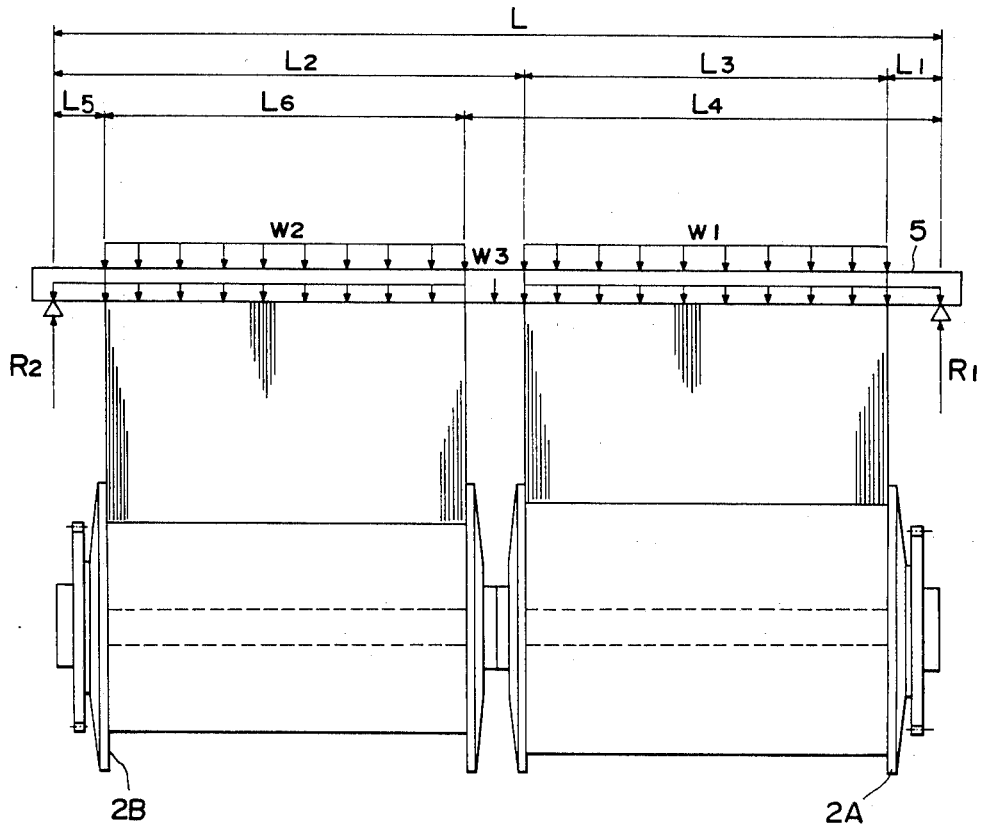
FIG. 4 is a schematic illustration showing distributions of loads acting on a tension roller.

FIG. 4 schematically shows warp tensions exerted on the tension roller 5 by the warp threads of the left and right warp beams 2A and 2B. As shown in FIG. 4, the tension roller 5 is supported at both ends. The tension of the warp threads of the left warp beam 2A exerts a force $w_1$ per unit axial length on a left part of the tension roller 5. This left part of the tension roller 5 has an axial length $L_3$, and is spaced at a distance $L_1$ from the left support of the tension roller 5 and at a distance $L_2$ from the right support, as shown in FIG. 4. The force $w_1$ can be regarded as a load uniformly distributed over the length $L_3$. The tension of the warp threads of the right warp beam 2B exerts a force $w_2$ per unit axial length on a right part of the tension roller 5. This right part of the tension roller 5 has a length $L_6$, and is spaced at a distance $L_5$ from the right support, and at a distance $L_4$ from the left support. The force $w_2$ can be regarded as a load uniformly distributed over the length $L_6$. The tension roller 5 further receives its own weight $w_3$ per unit axial length. The force $w_3$ can be regarded as a load uniformly distributed over a length L which is a distance between the left and right supports. Reaction forces $R_1$ and $R_2$ of the left and right support levers 6A and 6B act at the left and right supports, respectively.

From a known formula, a reaction $R_{1\omega1}$ at the left support of the tension roller 5 attributable to the warp tension of the left warp beam 2A, a reaction $R_{2\omega1}$ at the right support attributable to the warp tension of the left warp beam, a reaction $R_{1\omega2}$ at the left support attributable to the warp tension of the right warp beam 2B, a reaction $R_{2\omega2}$ at the right support attributable to the warp tension of the right warp beam 2B, a reaction $R_{2\omega3}$ at the left support attributable to the weight of the tension roller 5, and a reaction $R_{2\omega3}$ at the right support attributable to the weight of the tension roller 5 are given by:

$$R_{1\omega1}=\{w_1\times L_3\times(L_2+L_3/2)\}/L \quad (1\text{-}1)$$

$$R_{2\omega1}=\{w_1\times L_3\times(L_1+L_3/2)\}/L \quad (1\text{-}2)$$

$$R_{1\omega2}=\{w_2\times L_6\times(L_5+L_6/2)\}/L \quad (1\text{-}3)$$

$$R_{2\omega2}=\{w_2\times L_6\times(L_4+L_6/2)\}/L \quad (1\text{-}4)$$

$$R_{1\omega3}=R_{2\omega3}=(w_3\times L)/2 \quad (1\text{-}5)$$

The total reaction $R_1$ at the left support and the total reaction $R_2$ at the right support are;

$$R_1=R_{1\omega1}+R_{1\omega2}+R_{1\omega3} \quad (2\text{-}1)$$

$$R_2=R_{2\omega1}+R_{2\omega2}+R_{2\omega3} \quad (2\text{-}2)$$

From the equations (1-1) to (2-2);

$$R_1 = (L_3/L)\times(L_2+L_3/2)\times w_1 + (L_6/L)\times(L_5+L_6/2)\times w_2 + (L/2)\times w_3 \quad (3\text{-}1)$$

$$R_2 = (L_3/L)\times(L_1+L_3/2)\times w_1 + (L_6/L)\times(L_4+L_6/2)\times w_2 + (L/2)\times w_3 \quad (3\text{-}2)$$

Then, simplifying the equations (3-1) and (3-2) gives;

$$R_1''=A_1\times W_1+B_1\times W_2 \quad (4\text{-}1)$$

$$R_2''=A_2\times W_1+B_2\times W_2 \quad (4\text{-}2)$$

valuing the equations (4-1) and (4-2) for $w_1$ and $w_2$ gives;

$$w_1=\{B_2/(A_1\times B_2-A_2\times B_1)\}\times R_1''-\{B_1/(A_1\times B_2-A_2\times B_1)\}\times R_2'' \quad (5\text{-}1)$$

$$W_2=\}A_1/(A_1\times B_2-A_2\times B_1)\}\times R_2''-\{A_2/(A_1\times B_2-A_2\times B_1)\}\times R_1'' \quad (5\text{-}2)$$

Simplifying the equations (5-1) and (5-2) gives;

$$W_1=C\times R_1''+D\times R_2'' \quad (6\text{-}1)$$

In the equations (6-1) and (6-2), $R_1''=R_1-(L/2)\times w_3$, $R_2''=R_2-(L/2)\times w_3$, and $(L/2)\times w_3$ = a constant determined by the make of the loom. Therefore, $w_1$ and $w_2$ can be determined by detecting $R_1$ and $R_2$.

In this embodiment, the left load cell 19A transduces the force ($R_1$) applied on the left load cell 19A by the tension roller 5 through the left support lever 6A, the pin 10A and the left tension lever 9A, into an electric signal, and sends this signal to the control panel 21. Similarly, the right load cell 19B transduces the force ($R_2$) applied on it, into an electric signal, and sends this signal to the control panel 21. An operating means in the control panel 21 finds $w_1$ and $w_2$ by the use of the equations (6-1) and (6-2). Thus, the warp tensions per unit length of the left and right warp beams are determined.

The control panel 21 produces a left control signal in accordance with the warp tension $w_1$ of the left warp beam 2A per unit length of the tension roller, and sends the left control signal to the left pulse motor 31A. The control panel 21 also produces a right control signal in accordance with the warp tension $w_2$ of the right warp beam 2B per unit length, and sends the right control signal to the right pulse motor 31B. In response to the left control signal, the left pulse motor 31A shifts the speed change lever 23A of the left speed change device 22A. In response to the right control signal, the right pulse motor 31B shifts the speed change lever 23B of the right speed change device 22B. Thus, the left and right warp beams 2A and 2B are driven independently from each other in such a manner that a variation of the warp tension of one warp beam exerts no influence on the warp tension of the other warp beam.

In this embodiment, each of the load cells 19A and 19B is deformed so little by a variation of force applied on it that the displacement of each tension lever 9A or 9B is very small and negligible. Therefore, the tension roller 5 moves only according to the easing motion. The tension roller 5 of this embodiment is always kept substantially parallel to the axes of the left and right warp beams 2A and 2B in this way, so that there is no influence of an inclination of the tension roller on the warp tensions. In other words, any deviation of tension roller 5 from its parallel position would be negligible for purposes of consideration of loom operation.

Figure 5:
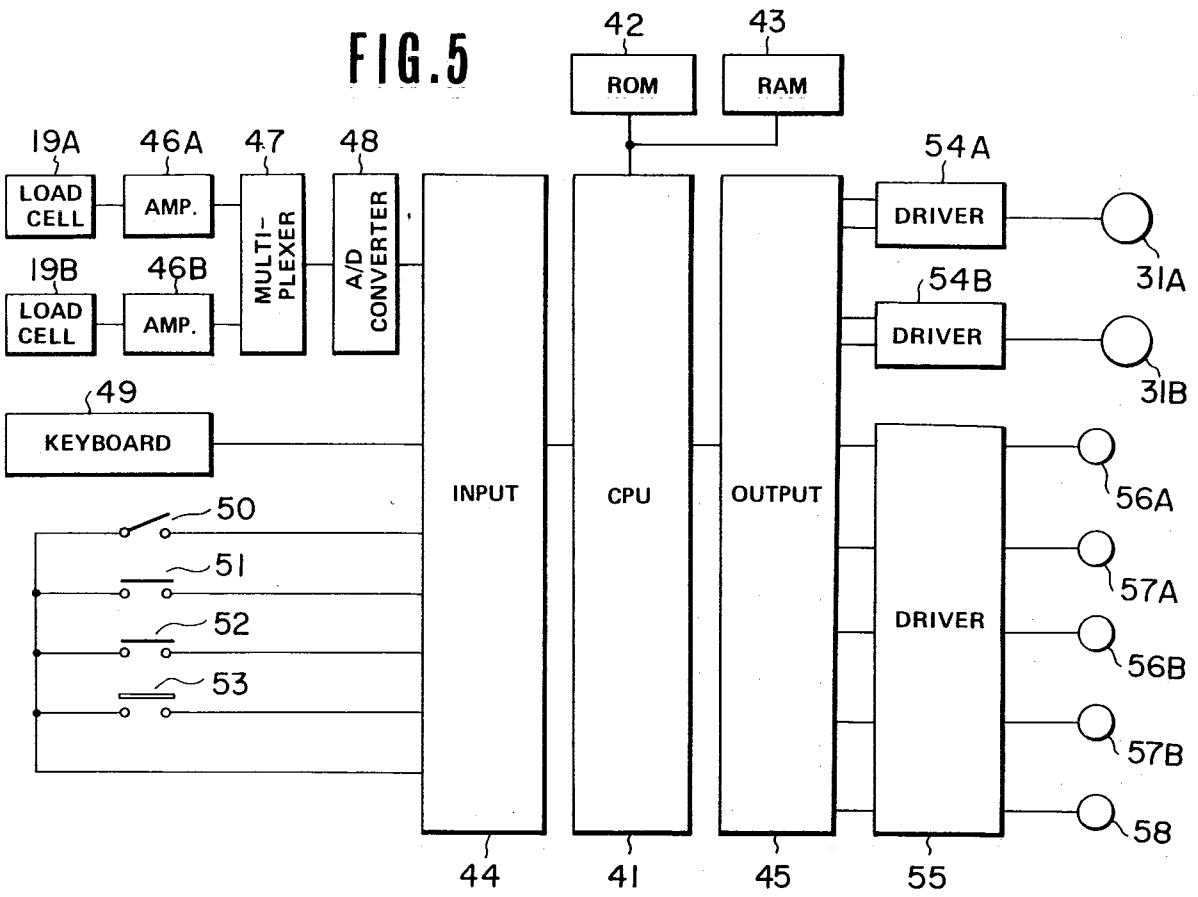
FIG. 5 is a block diagram of a control unit used in the first embodiment.

A microcomputer may be used as the control panel 21. In this case, a microcomputer is constructed as shown in the block diagram of FIG. 5. In FIG. 5, a CPU 41 is connected with a ROM 42 for storing programs, a RAM 43 for storing data, a digital input interface 44 and a digital output interface 45.

The left and right load cells 19A and 19B are connected, respectively, to amplifiers 46A and 46B, which are, in turn, connected to a multiplexer 47. The multiplexer 47 is connected to the input interface 44 through an A/D converter 48. A keyboard 49, an initial switch 50, a ready switch 51, a run switch 52 and a pick detecting switch 53 are connected to the input interface 44.

The output interface 45 is connected to a driver 54A for the left pulse motor 31A, a driver 54B for the right pulse motor 31B, and an abnormal signal driver 55. The abnormal signal driver 55 is connected to over-tension indicators 56A and 56B, under-tension indicators 57A and 57B, and an abnormal tension stop relay 58.

Figure 6:
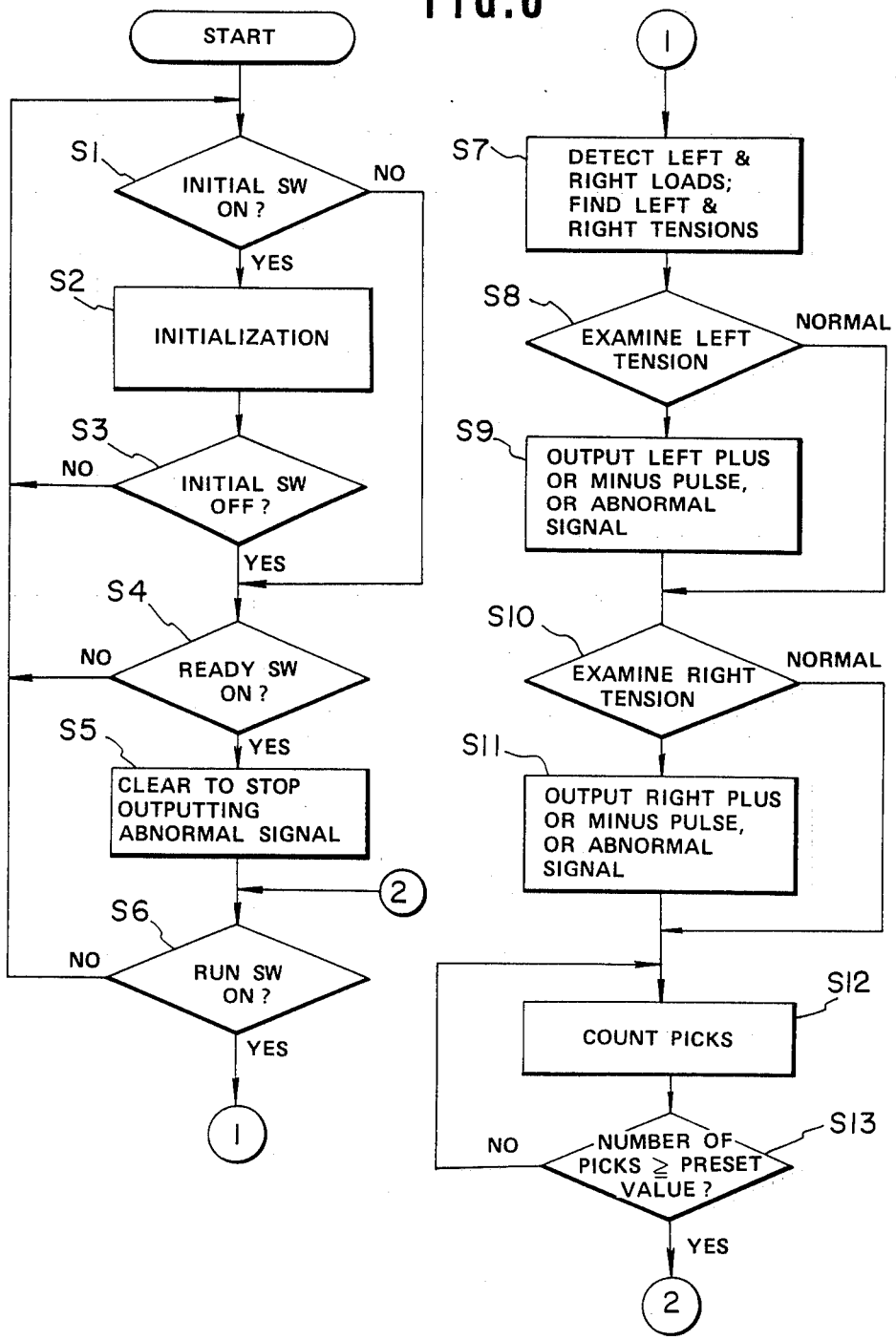
FIG. 6 is a flowchart of a program for the control unit of FIG. 5.

The CPU 41 controls the warp tensions of the left and right warp beams according to a program shown in the flowchart of FIG. 6. At a step S1, the CPU 41 determines whether the initial switch 50 is on. If the answer of the step S1 is YES, an initialization is performed at a step S2. That is, a sampling number of picks, a standard tension range, and an abnormal tension range are set with the keyboard 49. Moreover, the left and right loads are detected by the left and right load cells 19A and 19B, and left and right standard tensions are calculated. At a next step S3, the CPU determines whether the initial switch 50 is off. If it is, the CPU proceeds to a step S4. If it is not, the CPU returns to the step S1.

If the answer of the step S1 is NO, or if the answer of the step S3 is YES, the CPU determines whether the ready switch 51 is on at the step S4. If it is, the CPU proceeds to a step S5. If not, the CPU returns to the step S1.

If the answer of the step S4 is YES, the CPU clears a means for outputting the abnormal signal at a step S5, and then determines whether the run switch 52 is on or not, at a step S6. If the answer of the step S6 is YES, the CPU proceeds to a step S7. If the answer of the step S6 is NO, the CPU returns to the step S1.

During a normal operation of the loom where the run switch 52 is on, the CPU determines the left and right loads from the signals from the left and right load cells 19A and 19B, and calculates the left and right tensions from the left and right loads, at the step S7. At a next step S8, the CPU examines whether the left tension is within the standard tension range and within the abnormal tension range. At a step S9, the CPU gives a command to send a left pulse signal which is positive or negative, to the left pulse motor 31A according to the result of the examination of the step S8. If the left tension is out of the abnormal tension range, the CPU gives a command to produce the abnormal signal, at the step S9. At a step S10, the CPU examines the right tension, and at a step S11, the CPU gives a command to output a right pulse signal or the abnormal signal in the same manner. The CPU counts the number of picks at a step S12, and compares the number of picks with a preset value at a step S13. When the number of picks amounts to the preset value, the CPU returns to the step S6. Thus, the warp tensions are adjusted each time a predetermined number (50–100, for example) of picks of weft are inserted.

A second embodiment of the present invention is shown in FIGS. 7 to 10. In this embodiment, the left and right loads acting on the left and right supports of the tension roller are detected mechanically by left and right balances, and the angular movements of the left and right balances are transmitted to the speed change levers of the left and right speed change devices through a mechanical linkage which has a means for offsetting an influence of a left warp tension variation on the right load and an influence of a right warp tension variation on the left load. Unlike the first embodiment, the axis of the tension roller of the second embodiment can be moved into an inclined position in which the tension roller is not parallel to the axis of the warp beams.

Figure 7:
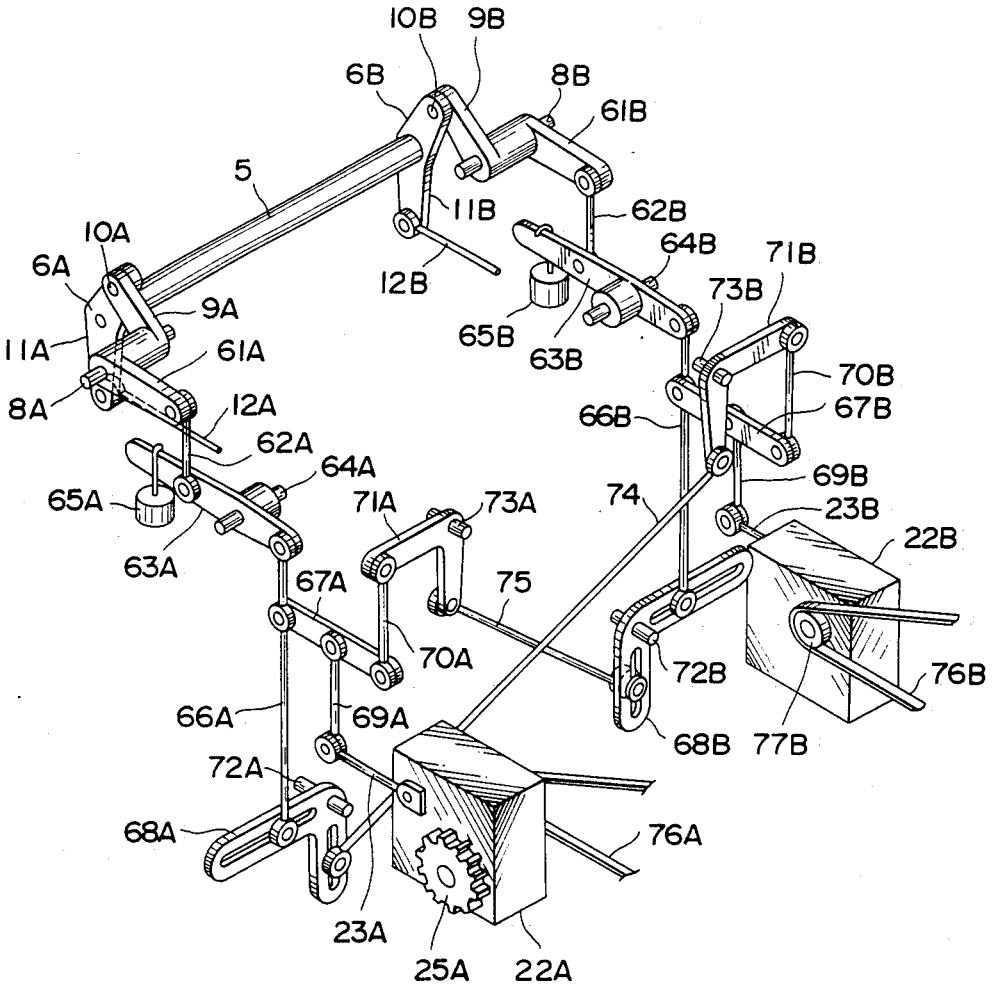
FIG. 7 is a perspective view of a warp tension control mechanism showing a second embodiment of the present invention.

As shown in FIG. 7, left and right ends of a tension roller 5 are connected, respectively, with speed change levers 23A and 23B of left and right speed change devices 22A and 22B through left and right link mechanisms which have the same construction and are arranged symmetrically. The tension roller 5 is rotatably supported at both ends by a left support lever 6A of the left link mechanism and a right support lever 6B of the right link mechanism. A first arm of the left support lever 6A is connected with a first arm of a left tension lever 9A through a pin 10A fixed to the first arm of the tension lever 9A. The left support lever 6A is rotatable on the pin 10A. The tension lever 9A is rotatable on a fixed shaft 8A. A second arm 11A of the left support lever 6A is connected with a left connecting rod 12A. The left and right support levers 6A and 6B are swung by the left connecting rod 12A and a right connecting rod 12B, respectively, and give an easing motion to the tension roller 5 in the same manner as in the first embodiment.

The tension lever 9A has a second arm 61A, which is connected with a first arm of a left weighing lever 63A through a connecting rod 62A. The weighing lever 63A is rotatable on a shaft 64A fixed to the loom frame. A weight member 65A is suspended from the first arm of the weighing lever 63A. The weight member 65A rotates or tends to rotate the weighing lever 63A in a counterclockwise direction in FIG. 7, and the warp tension which the tension roller 5 receives rotates or tends to rotate the weighing lever 63A in a clockwise direction.

A second arm of the weighing lever 63A is connected with a left connecting rod 66A, which is connected with a left floating lever 67A and a left adjusting lever 68A. A first end of the floating lever 67A is connected with the connecting rod 66A. A second end of the floating lever 67A is connected through a connecting rod 70A with a left compensating lever 71A. A middle portion of the floating lever 67A between the first and second ends is connected through a left connecting rod 69A with the speed change lever 23A of the left speed change device 22A. The adjusting lever 68A is rotatable on a fixed shaft 72A, and the compensating lever 71A is rotatable on a fixed shaft 73A. Thus, the pivot axes of the tension lever 9A, the weighing lever 63A, the adjusting lever 68A and the compensating lever 71A are stationary relative to the loom frame.

The right link mechanism also comprises the right support lever 6B, a right tension lever 9B, a right weighing lever 63B, a right floating lever 67B, a right adjusting lever 68B and a right compensating lever 71B, which are constructed in the same manner.

Figure 8:
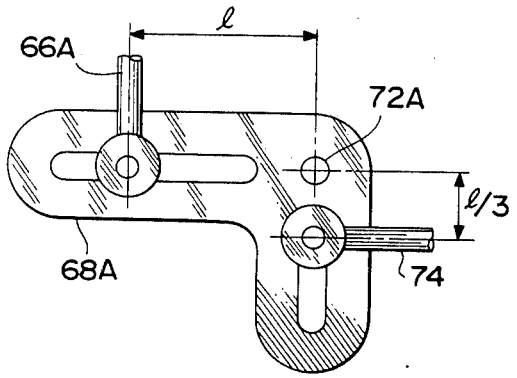
FIG. 8 is an enlarged view of an adjusting lever shown in FIG. 7.

The left adjusting lever 68A is connected with the right compensating lever 71B by a transverse connecting rod 74. The right adjusting lever 68B is connected with the left compensating lever 71A by a transverse connecting rod 75. The transverse connecting rods 74 and 75 extend from side to side of the loom. One of the connecting rods 74 and 75 slopes down in one direction, and the other in the opposite direction so that they crosses each other like the letter X when viewed from the front of the loom. As shown in FIG. 8, the distance between the fulcrum of the adjusting lever 68A and the connecting point of the connecting rod 66A, and the distance between the fulcrum and the connecting point of the connecting rod 74 are both adjustable. That is, the leverage of each of the adjusting levers 68A and 68B is adjustable.

Each of the speed change devices 22A and 22B changes the speed of a rotation which is transmitted from the main shaft of the loom to an input pulley 77A or 77B through a belt 76A or 76B. The rotation of an output gear 25A of the left speed change device is transmitted to the left warp beam through a left speed reducer, and the rotation of an output gear 25B of the right speed change device 22B to the right warp beam through a right speed reducer. Thus, the left and right warp beams are driven independently from each other.

Spherical bearings are used for the connecting portions of the connecting rods since the link mechanisms are three-dimensional.

Figure 9:
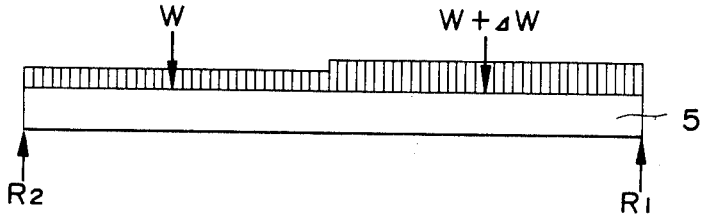
FIG. 9 is a schematic illustration showing distributions of loads acting on the tension roller.

In FIG. 9, it is assumed to simplify the problem that the widths of the left and right warp beams are equal to each other, and the warp tensions act on the tension roller 5 over the full width. Normally, the tension roller 5 is acted upon by a warp tension W of the left warp beam, and a warp tension W of the right warp beam. If the warp tension of the left warp beam is increased by $\Delta W$, as shown in FIG. 9 then the reaction forces $R_1$ and $R_2$ are given by;

$$\begin{aligned} R_1 &= (\tfrac{3}{4}) \times (W + \Delta W) + (\tfrac{1}{4}) \times W \\ &= W + (\tfrac{3}{4}) \times \Delta W \\ R_2 &= (\tfrac{3}{4}) \times W + (\tfrac{1}{4}) \times (W + \Delta W) \\ &= W + (\tfrac{1}{4}) \times \Delta W \end{aligned}$$

The left load acting on the left support of the tension roller 5 balances with the left weight member 65A, and the right load acting on the right support of the tension roller 5 balances with the right weight member 65B. Within a range of normal warp tension variations, it is possible to consider that the displacement of each end of the tension roller 5 is directly proportional to a variation of the load acting at the end of the tension roller 5.

The increase $\Delta W$ of the warp tension of the left warp beam shown in FIG. 9 causes the left tension lever 9A to rotate on the shaft 8A in the counterclockwise direction, so that the left weighing lever 63A rotates in the clockwise direction and the connecting rod 66A moves downwards.

Because the left tension increase $\Delta W$ increases not only the left reaction force $R_1$ but also the right reaction force $R_2$, the right tension lever 9B also rotates in the counterclockwise direction, the right weighing lever 63B rotates in the clockwise direction, and the right connecting rod 66B moves downwards. In this case, the increase of the right reaction force $R_2$ is equal to one third of the increase of the left reaction force, and accordingly the downward displacement of the right connecting rod 66B is equal to one third of the downward displacement S of the left connecting rod 66A.

Figure 10A:
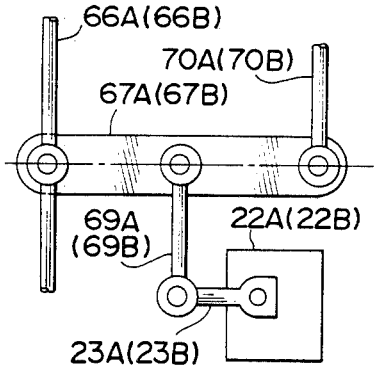
FIGS. 10A, 10B and 10C are views showing movements of left and right floating levers and left and right speed change levers shown in FIG. 7.
Figure 10B:
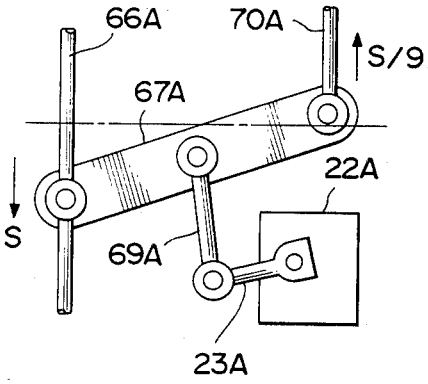
Figure 10C:
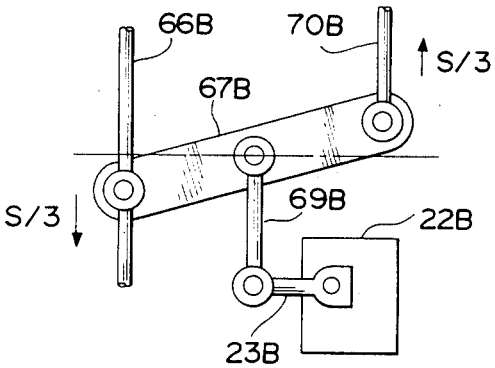

The downward movement of the left connecting rod 66A causes the first end of the left floating lever 67A to move downwards from the standard position shown in FIG. 10A, and the downward movement of the right connecting rod 66B causes the first end of the right floating lever 67B to move downwards from the standard position shown in FIG. 10A. The distance traveled by the first end of the left floating lever 67A is equal to S as shown in FIG. 10B, and the distance traveled by the first end of the right floating lever 67B is equal to S/3 as shown in FIG. 10C.

In this embodiment, the distance between the connecting point of the left connecting rod 66A and the axis of the shaft 72A is equal to l, and the distance between the connecting point of the transverse connecting rod 74 and the axis of the shaft 72A is equal to l/3, as shown in FIG. 8. The leverage of the right adjusting lever 68B is adjusted at the same ratio. Therefore, the downward movement of the left connecting rod 66A causes the transverse connecting rod 74 to move through a distance S/3, and the downward movement of the right connecting rod 66B causes the transverse connecting rod 75 to move through a distance S/9.

This movement of the transverse connecting rod 74 causes the right compensating lever 71B to rotate in the counter clockwise direction, so that the second end of the right floating lever 67B is lifted up through a distance S/3 by the connecting rod 70B.

The movement of the transverse connecting rod 75 causes the left compensating lever 71A to rotate in the clockwise direction, so that the second end of the left floating lever 67A is lifted up through a distance S/9 by the connecting rod 70A.

Thus, the first end of the right floating lever 67B is pushed down through S/3, and the second end of the right floating lever 67B is pulled up through S/3, as shown in FIG. 10C. As a result, the middle portion of the right floating lever 67B remains stationary in the standard position, and accordingly the speed change lever 23B of the right speed change device 22B is not shifted. The warp tension of the right warp beam is held constant notwithstanding the increase of the load acting on the right support of the tension roller 5.

The first end of the left floating lever 67A is pushed down through S, and the second end of the left floating lever is pulled up through S/9, as shown in FIG. 10B. Therefore, the speed change lever 23A of the left speed change device 22A is shifted by the left floating lever 67A, so that the speed of the left warp beam is controlled adequately.

An inclination of the tension roller 5 slightly changes the lengths of the paths of the warp threads. However, the influence of an inclination of the tension roller 5 on the warp tensions is negligible because, in each of the left and right link mechanisms, the displacement of the speed change lever is much larger than the displacement of the end of the tension roller to such an extent that the displacement of the tension roller end is multiplied by several tens, and moreover the displacement of the speed change lever is normally very small.

By adjusting the left and right weight members, and the leverages of the left and right adjusting levers, it is possible to maintain the left and right warp tensions equal even if the widths of the left and right warp beams are not equal. Moreover, it is possible to control the left and right warp tensions at different values by adjusting the weight members and the adjusting levers. The diameters of the left and right warp beams need not be equal since the speed of each warp beam is controlled independently by detecting each warp tension.

What is claimed is:

1. A loom comprising:

left and right warp beams, a tension roller through which warp threads of both of said left and right warp beams are delivered, said tension roller being supported at both ends, left load sensing means for sensing a load acting at the left support point of said tension roller, and right load sensing means for sensing a load acting at the right support point of said tension roller, left warp let-off speed regulating means for controlling the rotational speed of said left warp beam, and right warp let-off speed regulating means for controlling the rotational speed of said right warp beam, and control means, connected with said left and right load sensing means, for (i) detecting a left load deviation of the load sensed by said left load sensing means and a right load deviation of the load sensed by said right load sensing means, (ii) determining left and right tension deviations which represent, respectively, a deviation of a left total force applied by the tension of the warp threads of said left warp beam on said tension roller at a left application point and a deviation of a right total force applied by the tension of the warp threads of said right warp beam on said tension roller at a right application point and which are, respectively, left and right functions of the left and right load deviations, and so determine whether the left and right functions satisfy, at least approximately, both of a first relationship that the left load deviation, is equal to a sum of the left tension deviation multiplied by a ratio of a distance between the left application point and the right support point to a span between the left and right support points and the right tension deviation multiplied by a ratio of a distance between the right application point and the right support point to the span and a second relationship that the right load deviation is equal to a sum of the left tension deviation multiplied by a ratio of a distance between the left application point and the left support point to the span and the right tension deviation multiplied by a ratio of a distance between the right application point and the left support point to the span, and (iii) controlling the rotational speed of the left warp beam in accordance with the left tension deviation by manipulating said left speed regulating means, and controlling the rotational speed of said right warp beam in accordance with the right tension deviation by manipulating said right speed regulating means.

2. A loom according to clalm 1, wherein said left and right load sensing means are left and right load cells, respectively, and said controlling means comprises electric means which finds the warp tensions of said left and right warp beams from the loads sensed by said left and right load sensing means and produces said left and right control signals which are electric.

3. A loom according to claim 2, further comprising a left support lever rotatably supporting said tension roller at the left support point, a right support lever rotatably supporting said tension roller at the right support point, a left tension lever swingable about a fixed fulcrum, having a first arm pivotally connected with said left support lever and a second arm pressing said left load cell in accordance with the load acting at the left support point, and a right tension lever swingable about a fixed fulcrum, having a first arm pivotally connected with said right support lever and a second arm pressing said right load cell in accordance with the load acting at the right support point.

4. A loom according to claim 3, wherein said controlling means comprises a digital computer.

5. A loom according to claim 1, wherein said left load sensing means comprises a left swingable weighing lever whose angular position is determined by the load acting at the left support point of said tension roller, and said right load sensing means comprises a right swingable weighing lever whose angular position is determined by the load acting at the right support point of said tension roller, and wherein said controlling means is a mechanical linkage.

6. A loom according to claim 5, further comprising a left support lever rotatably supporting said tension roller at the left support point, a right support lever rotatably supporting said tension roller at the right support point, a left tension lever having a first arm pivotally connected with said left support lever and a second arm, and a right tension lever having a first arm pivotally connected with said right support lever and a second arm, wherein said left weighing lever has a first arm connected with said second arm of said left tension lever through a first left connecting rod and a second arm connected with a second left connecting rod which moves longitudinally in a left increasing direction in accordance with an increase of the load acting at the left support point of said tension roller and in a left decreasing direction in accordance with a decrease of the load acting at the left support point of said tension roller, and said right weighing lever has a first arm connected with said second arm of said right tension lever through a first right connecting rod and a second arm connected with a second right connecting rod which moves longitudinally in a right increasing direction in accordance with an increase of the load acting at the right support point and in a right decreasing direction in accordance with a decrease of the load acting at the right support point.

7. A loom according to claim 6, wherein said left load sensing means further comprises a left weight member connected with said left weighing lever for exerting on said left weighing lever a force counter-balancing the load acting at the left support point, and said right load sensing means further comprises a right weight member connected with said right weighing lever for exerting on said right weighing lever a force counterbalancing the load acting at the right support point.

8. A loom according to claim 7, wherein said controlling means comprises a left floating lever having a first end connected with said second left connecting rod, a second end connected with a third left connecting rod substantially parallel to said second left connecting rod, and a middle portion connected with said left warp let-off speed regulating means through a fourth left connecting rod, leftward motion transmitting means connected between said second right connecting rod and said third left connecting rod for changing a longitudinal motion of said second right connecting rod in the right increasing direction into a longitudinal motion of said third left connecting rod in the left decreasing direction and a longitudinal motion of said second right connecting rod in the right decreasing direction into a longitudinal motion of said third left connecting rod in the left increasing direction according to a predetermined left ratio of a distance of a longitudinal motion of said second right connecting rod to a distance of a longitudinal motion of said third left connecting rod, a right floating lever having a first end connected with said second right connecting rod, a second end connected with a third right connecting rod substantially parallel to said second right connecting rod and a middle portion connected with said right warp let-off speed regulating means through a fourth right connecting rod, and rightward motion transmitting means connected between said second left connecting rod and said third right connecting rod for changing a longitudinal motion of said second left connecting rod in the left increasing direction into a longitudinal motion of said third right connecting rod in the right decreasing direction and a longitudinal motion of said second left connecting rod in the left decreasing direction into a longitudinal motion of said third right connecting rod in the right increasing direction according to a predetermined right ratio of a distance of a longitudinal motion of said second left connecting rod to a distance of a longitudinal motion of said third left connecting rod.

9. A loom according to claim 8, wherein said leftward transmitting means comprises a right swingable adjusting lever having a first arm connected with said second right connecting rod at a first point whose distance from a fulcrum of said right adjusting lever is adjustable, and a second arm connected with a leftward transverse connecting rod at a second point whose distance from the fulcrum of said right adjusting lever is adjustable and a left swingable compensating lever having a first arm connected with said leftward transverse connecting rod and a second arm connected with said third left connecting rod, and said rightward transmitting means comprises a left swingable adjusting lever having a first arm connected with said second left connecting rod at a first point whose distance from a fulcrum of said left adjusting lever is adjustable and a second arm connected with a rightward transverse connecting rod at a second point whose distance from the fulcrum of said left adjusting lever is adjustable and a right swingable compensating lever having a first arm connected with said rightward transverse connecting rod and a second arm connected with said third right connecting rod.

10. A loom according to claim 9, wherein said left and right ratios are both greater than one.

11. A loom comprising:

left and right warp beams, a tension roller through which warp threads of both of said left and right warp beams are delivered, said tension roller being supported at both ends, left load sensing means for sensing a load acting at the left support point of said tension roller, and right load sensing means for sensing a load acting at the right support point of said tension roller, left warp let-off speed regulating means for controlling the rotational speed of said left warp beam and right warp let-off speed regulating means for controlling the rotational speed of said right warp beam, and electric control means, connected with said left and right load sensing means, for (i) determining a left force $w_1$ and a right force $w_2$ which satisfy both of first and second equations expressed, respectively, as:

$$R_1=(L_3/L)\times(L_2+L_3/2)\times w_1+(L_6/L)\times(L_5+L_6/2)\times w_2=(L/2)\times w_3$$

$$R_2=(L_3/L)\times(L_1+L_3/2)\times w_1+(L_6/L)\times(L_4+L_6/2)\times w_2+(L/2)\times w_3$$

wherein $R_1$ is a reaction at the left support point which is equal to the load sensed by said left load sensing means, $R_2$ is a reaction at the right support point which is equal to the load sensed by said right load sensing means, L is a length between the left and right support points, $L_3$ is a length of a left part of said tension roller which is loaded by the warp threads of said left warp beam, $L_1$ is a length of a space between the left part of said tension roller and the left support point in which said tension roller is not loaded, $L_2$ is a length of a space between the left part of said tension roller and the right support point, $L_6$ is a length of a right part of said tension roller which is loaded by the warp threads of said right warp beam, $L_4$ is a length of a space between the right part and the left support point of said tension roller, $L_5$ is a length of a space between the right part and the right support point of said tension roller in which said tension roller is not loaded and $w_3$ is a weight of said tension roller per unit axial length, and (ii) controlling the rotational speed of said left warp beam in accordance with the left force $w_1$ by manipulating said left speed regulating means and controlling the rotational speed of said right warp beam in accordance with the right force $w_2$ by manipulating said right speed regulating means.

12. A loom comprising:

left and right warp beams, a tension roller through which warp threads of both of said left and right warp beams are delivered, said tension roller being support at both ends, left warp let-off speed regulating means for controlling the rotational speed of said left warp beam and right warp let-off speed regulating means for controlling the rotational speed of said right warp beam, left load sensing means comprising a left swingable weighing lever having a first arm connected with the left support point of said tension roller and a second arm connected with a left vertical rod which extedds substantially vertically and is moved longitudinally by said left weighing lever in accordance with the load acting at the left support point of said tension roller, and right load sensing means comprising a right swingable weighing lever havimg a first arm connected with the right support point of said tension roller and a second arm connected with a right vertical rod which extends substantially vertically and is moved longitudinally by said right weighing lever in accordance with the load acting at the right support point of said tension roller, and mechanical control means comprising a left floating lever having a first end connected with said left vertical rod, a second end connected with a left parallel rod substantially parallel to said left vertical rod and a middle portion connected with said left speed regulating means, a right floating lever having a first end connected with said right vertical rod, a second end connected with a right parallel rod substantially parallel to said right vertical rod and a middle portion connected with said right speed regulating means, leftward motion transmitting mechanical means connected between said right vertical rod and said left parallel rod for changing a longitudinal motion of said right vertical rod in one direction into a longitudinal motion of said left parallel rod in the opposite direction according to a predetermined left ratio, and rightward motion transmitting mechanical means connected between said left vertical rod and said right parallel rod for changing a longitudinal motion of said left vertical rod in one direction into a longitudinal motion of said right parallel rod in the opposite direction according to a predetermined right ratio.

* * * * *